US009498803B2

(12) United States Patent
Hunter

(10) Patent No.: US 9,498,803 B2
(45) Date of Patent: Nov. 22, 2016

(54) CLEANING OF PIPELINES

(71) Applicant: HALLIBURTON ENERGY SERVICES, INC., Houston, TX (US)

(72) Inventor: Timothy H. Hunter, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 342 days.

(21) Appl. No.: 13/914,095

(22) Filed: Jun. 10, 2013

(65) Prior Publication Data

US 2014/0360533 A1 Dec. 11, 2014

(51) Int. Cl.

| | |
|---|---|
| ***B08B 9/032*** | (2006.01) |
| ***B08B 9/055*** | (2006.01) |
| ***B08B 9/043*** | (2006.01) |
| ***B08B 9/053*** | (2006.01) |

(52) U.S. Cl.

CPC ..... *B08B 9/0321* (2013.01); *B08B 9/0433* (2013.01); *B08B 9/0535* (2013.01); *B08B 9/0551* (2013.01)

(58) Field of Classification Search

CPC ..... B08B 9/032; B08B 9/053; B08B 9/0535; B08B 9/055; B08B 3/02; B08B 3/04; B08B 2209/053; B08B 2209/055; B08B 2209/027

See application file for complete search history.

(56) References Cited

U.S. PATENT DOCUMENTS

| | | | |
|---|---|---|---|
| 3,091,393 | A | 5/1963 | Sparrow |
| 3,461,897 | A | 8/1969 | Kwok |
| 4,137,928 | A | 2/1979 | Sentell |
| 4,276,943 | A | 7/1981 | Holmes |
| 4,385,875 | A | 5/1983 | Kanazawa |
| 4,418,721 | A | 12/1983 | Holmes |
| 4,895,178 | A | 1/1990 | McHugh |
| 5,455,804 | A | 10/1995 | Holmes et al. |

(Continued)

FOREIGN PATENT DOCUMENTS

| | | | |
|---|---|---|---|
| JP | 2000061420 | A | 2/2000 |
| WO | 2011070321 | A2 | 6/2011 |
| WO | WO-2014200654 | | 12/2014 |

OTHER PUBLICATIONS

Machine translation: JP 2000-061420; Koike et al. (2000).*

(Continued)

*Primary Examiner* — Michael Kornakov
*Assistant Examiner* — Natasha Campbell
(74) *Attorney, Agent, or Firm* — Schwegman Lundberg & Woessner, P.A.; Alan Bryson

(57) ABSTRACT

A pipeline cleaning system can include a pipeline cleaning apparatus with at least one fluid director that causes fluid which flows through the fluid director to repeatedly change direction. A method of cleaning a pipeline can include inserting a pipeline cleaning apparatus into the pipeline, flowing a fluid, thereby causing the fluid to be discharged from the pipeline cleaning apparatus into the pipeline, and a fluid director of the pipeline cleaning apparatus repeatedly changing a direction of discharge of the fluid from the pipeline cleaning apparatus. A pipeline cleaning apparatus can include a housing adapted for insertion into a pipeline, and at least one fluid director that repeatedly changes a direction of discharge of fluid from the pipeline cleaning apparatus, in response to flow of the fluid through the apparatus.

22 Claims, 3 Drawing Sheets

(56) References Cited

U.S. PATENT DOCUMENTS

| | | | | |
|---|---|---|---|---|
| 5,795,402 | A * | 8/1998 | Hargett et al. | 134/8 |
| 6,233,746 | B1 | 5/2001 | Skinner | |
| 6,345,963 | B1 | 2/2002 | Thomin et al. | |
| 6,497,252 | B1 | 12/2002 | Kohler et al. | |
| 6,508,261 | B1 * | 1/2003 | Nezat, II | E03F 9/002 134/167 C |
| 6,747,743 | B2 | 6/2004 | Skinner et al. | |
| 7,159,468 | B2 | 1/2007 | Skinner et al. | |
| 7,511,823 | B2 | 3/2009 | Schultz et al. | |
| 2009/0065197 | A1 | 3/2009 | Eslinger | |
| 2011/0048559 | A1 | 3/2011 | Stutchbury | |
| 2011/0186300 | A1 | 8/2011 | Dykstra et al. | |
| 2012/0168014 | A1 * | 7/2012 | Schultz et al. | 137/826 |
| 2013/0048274 | A1 | 2/2013 | Schultz et al. | |

OTHER PUBLICATIONS

International Search Report with Written Opinion issued Sep. 30, 2014 for PCT Patent Application No. PCT/US2014/038092, 12 pages.

Lee Precision Micro Hydraulics, Lee Restrictor Selector product brochure; Jan. 2011, 9 pages.

Tesar, V.; Fluidic Valves for Variable-Configuration Gas Treatment; Chemical Engineering Research and Design journal; Sep. 2005; pp. 1111-1121, 83(A9); Trans IChemE; Rugby, Warwickshire, UK.

Tesar, V.; Sampling by Fluidics and Microfluidics; Acta Polytechnica; Feb. 2002; pp. 41-49; vol. 42; The University of Sheffield; Sheffield, UK.

Tesar, V., Konig, A., Macek, J., and Baumruk, P.; New Ways of Fluid Flow Control in Automobiles: Experience with Exhaust Gas Aftertreament Control; 2000 FISITA World Automotive Congress; Jun. 12-15, 2000; 8 pages; F2000H192; Seoul, Korea.

International Search Report and Written Opinion issued Mar. 25, 2011 for International Patent Application Serial No. PCT/US2010/044409, 9 pages.

International Search Report and Written Opinion issued Mar. 31, 2011 for International Patent Application Serial No. PCT/US2010/044421, 9 pages.

Office Action issued Jun. 26, 2011 for U.S. Appl. No. 12/791,993, 17 pages.

Halliburton Application and Drawings filed Jan. 11, 2011 with U.S. Appl. No. 13/004,135.

Boots & Coots, "Pulsonix TFA Service: Innovative Process for Optimizing Matrix Treatment Effectiveness", 2013, H08330, 2 pages.

Boots & Coots, "Boots & Coots Develops Third Generation Oscillation Tools", Product/Service Announcement, May 1, 2012, 1 page, Halliburton, Houston, Texas.

* cited by examiner

CLEANING OF PIPELINES

BACKGROUND

This disclosure relates generally to equipment utilized and operations performed in conjunction with pipelines and, in an example described below, more particularly provides for cleaning of pipelines.

Debris, deposits and other substances can accumulate in a pipeline. The substances can restrict flow through the pipeline, and can cause other undesired consequences. Therefore, it will be appreciated that advancements in the art of cleaning pipelines are continually needed.

DETAILED DESCRIPTION

Figure 1:
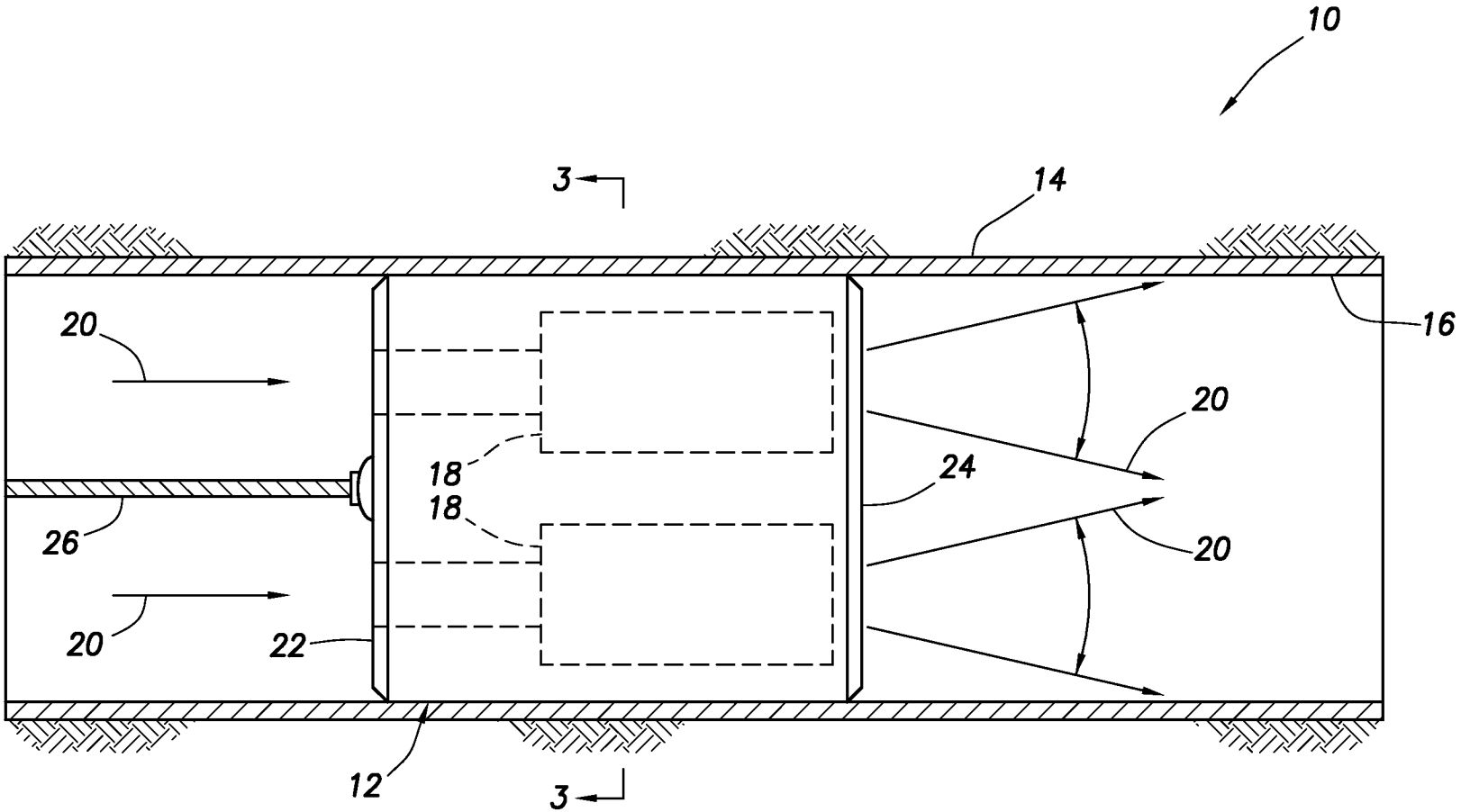
FIG. 1 is a representative partially cross-sectional view of a pipeline system and associated method which can embody principles of this disclosure.

Representatively illustrated in FIG. 1 is a pipeline cleaning system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a pipeline cleaning apparatus 12 is displaced through a pipeline 14, in order to clean an interior of the pipeline. For example, it may be desired to remove substances (such as, hydrates, debris, scale, paraffins, etc.) from an interior surface 16 of the pipeline. However, it should be clearly understood that the scope of this disclosure is not limited to removal of any particular substance from any particular portion of a pipeline.

The apparatus 12 is provided with one or more fluid directors 18 that cause a fluid 20 to repeatedly change direction as the fluid is discharged from the apparatus. For example, the fluid 20 could comprise a solvent, another cleaning fluid, an abrasive, etc.

The fluid directors 18 could cause the fluid 20 to "sweep" back and forth across the interior surface 16 of the pipeline 14, cause the fluid to oscillate, and/or cause the fluid to alternately change direction. It is contemplated that such repeated changes in direction of discharge of the fluid 20 will be effective to dislodge the substances, and to convey the substances through the pipeline 14 ahead of the apparatus 12.

In the FIG. 1 example, the apparatus 12 is displaced through the pipeline 14 in response to a pressure differential being created across the apparatus in the pipeline. For example, the fluid 20 can be pumped into the pipeline 14 on one side 22 of the apparatus 12, thereby elevating pressure in the pipeline on that side of the apparatus. The fluid 20 is discharged from an opposite side 24 of the apparatus 12.

In this example, the displacement of the apparatus 12 through the pipeline 14 due to the pressure differential can be controlled by means of a restraining device 26. In FIG. 1, the restraining device 26 is depicted as a cable, but in other examples a tubular, a line, a strap or another type of restraining device may be used.

The restraining device 26 applies a biasing force to the apparatus 12 to counteract an oppositely directed force due to the pressure differential acting on the apparatus. Note that, in the FIG. 1 example, the apparatus 12 is not sealed in the pipeline 14, but in other examples seals could be provided on the apparatus to enhance the creation of the pressure differential across the apparatus.

Note that it is not necessary for a pressure differential to be created across the apparatus 12, in order to displace the apparatus through the pipeline 14. For example, a coiled tubing could be used to displace the apparatus 12 through the pipeline 14, and to serve as a conduit for flowing the fluid 20 to the apparatus. Thus, the scope of this disclosure is not limited to the details of the apparatus 12 and system 10 as depicted in FIG. 1.

Figure 2:
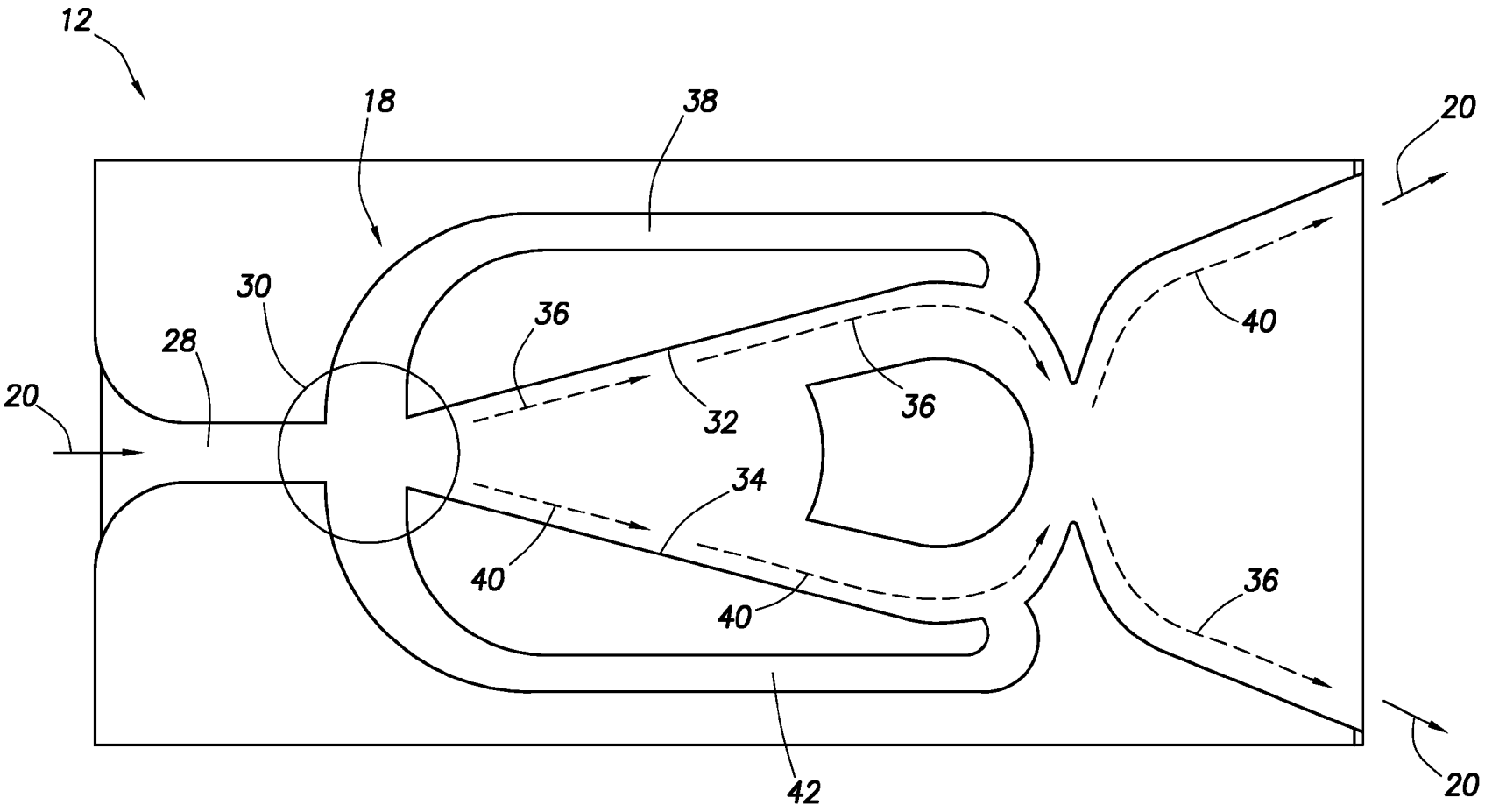
FIG. 2 is a representative side view of a fluid director which may be used in the system and method of FIG. 1.

Referring additionally now to FIG. 2, an enlarged scale side view of one example of the fluid director 18 is representatively illustrated apart from the remainder of the apparatus 12. The fluid director 18 depicted in FIG. 2 is of the type known to those skilled in the art as a fluidic oscillator, but it should be clearly understood that other types of fluid directors may be used, in keeping with the scope of this disclosure.

The fluid 20 enters an inlet passage 28 of the fluid director 18 and then flows through a fluidic switch 30. The fluidic switch 30 is used to control a direction of flow of the fluid 20 through the remainder of the fluid director 18.

Downstream of the fluidic switch 30 are two elongated and diverging surfaces 32, 34. Due to the well-known Coanda effect, the fluid 20 will tend to flow along one of the surfaces 32, 34 when it exits the fluidic switch 30.

Assuming for convenience that the fluid 20 initially flows along the surface 32, the fluid will follow a flow path 36 (shown in dashed lines in FIG. 2) through the fluid director 18. The fluid 20 will, thus, be discharged in a downward direction as viewed in FIG. 2.

A feedback passage 38 will receive some of the fluid 20 flowed via the flow path 36, and will direct this fluid to one side of the fluidic switch 30. Similarly, if the fluid 20 follows another flow path 40 along the surface 34 and is discharged upwardly as viewed in FIG. 2, another feedback passage 42 will receive some of the fluid, and will direct this fluid to an opposite side of the fluidic switch 30.

Fluid 20 directed to the fluidic switch 30 via the feedback passage 38 will tend to deflect the fluid toward the flow path 40, whereas fluid directed to the fluidic switch 30 via the feedback passage 42 will tend to deflect the fluid toward the flow path 36. Thus, the fluidic switch 30 will deflect the fluid 20 toward the flow paths 36, 40 alternately, causing the fluid to be discharged alternately upwardly and downwardly from the fluid director 18 (as viewed in FIG. 2).

Preferably, the fluid director 18 is arranged in the apparatus 12, so that the fluid 20 is discharged and flows across the interior surface 16 of the pipeline 14 (see FIG. 1), in order to dislodge substances from the surface. However, the scope of this disclosure is not limited to this arrangement of the fluid director 18, since, for example, the fluid director could be positioned so that the discharged fluid 20 effectively pushes substances through the pipeline 14 ahead of the apparatus 12, etc.

Figure 3:
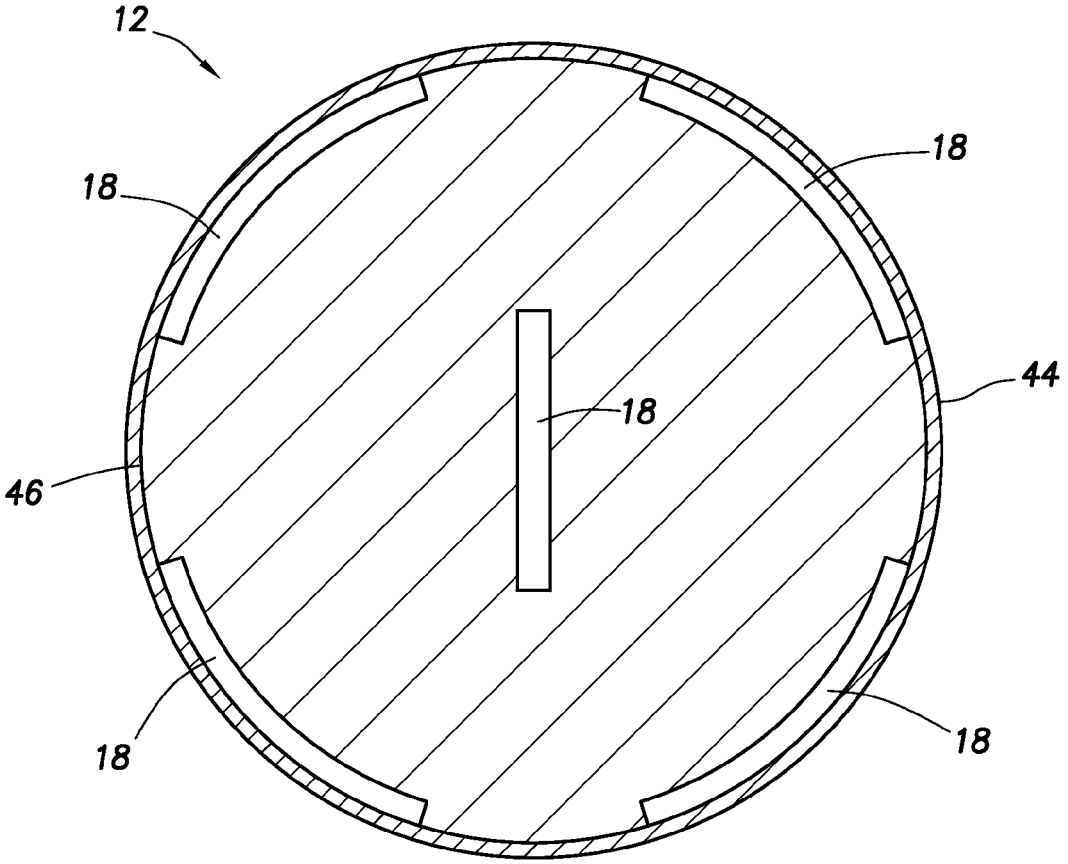
FIG. 3 is a representative cross-sectional view of a pipeline cleaning apparatus of the system, taken along line 3-3 of FIG. 1.

Referring additionally now to FIG. 3, a cross-sectional view of one example of the apparatus 12 is representatively illustrated, apart from the remainder of the system 10. In this example, four of the fluid directors 18 are arranged equally circumferentially spaced apart in an outer housing 44 of the apparatus 12. Another fluid director 18 is centrally positioned in an inner body 46 of the apparatus 12.

In this example, the fluid directors 18 are formed directly on the inner body 46 (for example, by milling, molding, electron discharge machining, three-dimensional printing, etc.). However, in other examples, the fluid directors 18 could be formed on separate replaceable inserts for ease of maintenance, tailoring the fluid directors to specific applications, etc. Thus, the scope of this disclosure is not limited to the specific details of the apparatus 12 or fluid directors 18 depicted in the drawings. Any number, any configuration and any arrangement of fluid director(s) 18 may be used in keeping with the principles of this disclosure.

It may now be fully appreciated that the above disclosure provides significant advancements to the art of cleaning pipelines. In examples described above, the pipeline 14 can be effectively cleaned using the apparatus 12 which displaces through the pipeline and directs the fluid 20 to flow in repeatedly changing directions.

A pipeline cleaning system 10 is provided to the art by the above disclosure. In one example, the system 10 can comprise a pipeline cleaning apparatus 12 including at least one fluid director 18 that causes fluid 20 which flows through the fluid director 18 to repeatedly change direction.

The pipeline cleaning apparatus 12 may be slidingly and/or sealingly received in a pipeline 14.

Pressure of the fluid 20 on one side 22 of the pipeline cleaning apparatus 12 may displace the apparatus through a pipeline 14, and the fluid 20 may be discharged from the fluid director 18 on an opposite side 24 of the apparatus 12. A restraining device 26 can limit a speed of displacement of the apparatus 12 through the pipeline 14.

The fluid director 18 may cause the fluid 20 to oscillate back and forth as the fluid is discharged from the fluid director. The fluid director 18 can alternate the direction as the fluid 20 is discharged from the fluid director.

The fluid director 18 may include a fluidic switch 30 which changes the direction of the fluid 20 as the fluid is discharged from the fluid director.

A method of cleaning a pipeline 14 is also described above. In one example, the method can comprise: inserting a pipeline cleaning apparatus 12 into the pipeline 14; flowing a fluid 20, thereby causing the fluid to be discharged from the pipeline cleaning apparatus 12 into the pipeline 14; and a fluid director 18 of the pipeline cleaning apparatus 12 repeatedly changing a direction of discharge of the fluid 20 from the pipeline cleaning apparatus.

The step of flowing the fluid 20 can include elevating pressure in the pipeline 14 on one side 22 of the pipeline cleaning apparatus 12, the fluid being discharged from an opposite side 24 of the apparatus.

The step of flowing the fluid 20 can include creating a pressure differential across the pipeline cleaning apparatus 12, thereby displacing the apparatus in the pipeline 14.

The method can also include a restraining device 26 applying a biasing force to the pipeline cleaning apparatus 12, thereby limiting the displacing of the apparatus.

The inserting step can include sealing the pipeline cleaning apparatus 12 in the pipeline 14.

The direction changing step can include alternating the direction of discharge of the fluid 20, oscillating the fluid back and forth, and/or sweeping the fluid back and forth across an interior surface 16 of the pipeline 14.

A pipeline cleaning apparatus 12 is also described above. In one example, the apparatus 12 can include a housing 44 adapted for insertion into a pipeline 14, and at least one fluid director 18 in the housing that repeatedly changes a direction of discharge of fluid 20 from the pipeline cleaning apparatus 12, in response to flow of the fluid through the apparatus.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A pipeline cleaning system, comprising:

a pipeline cleaning apparatus including a plurality of fluid directors arranged in a housing adapted for insertion into a pipeline, the plurality of fluid directors having a number of fluid directors arranged circumferentially in the housing and one fluid director of the plurality of fluid directors centrally positioned within the housing such that at least one fluid director of the plurality of fluid directors causes fluid which flows through the at least one fluid director to repeatedly change direction.

2. The system of claim 1, wherein the pipeline cleaning apparatus is slidingly received in the pipeline.

3. The system of claim 1, wherein the pipeline cleaning apparatus is sealingly received in the pipeline.

4. The system of claim 1, wherein pressure of the fluid on one side of the pipeline cleaning apparatus displaces the apparatus through the pipeline, and wherein the fluid is discharged from the fluid director on an opposite side of the apparatus.

5. The system of claim 1, wherein pressure of the fluid on one side of the pipeline cleaning apparatus displaces the apparatus in the pipeline, and wherein a restraining device limits a speed of displacement of the apparatus through the pipeline.

6. The system of claim 1, wherein the at least one fluid director causes the fluid to oscillate back and forth as the fluid is discharged from the at least one fluid director.

7. The system of claim 1; wherein the at least one fluid director alternates the direction as the fluid is discharged from the at least one fluid director.

8. The system of claim 1, wherein the at least one fluid director includes a fluidic switch which changes the direction of the fluid as the fluid is discharged from the at least one fluid director.

9. A method of cleaning a pipeline, the method comprising:

inserting a pipeline cleaning apparatus into the pipeline, the pipeline cleaning apparatus including a plurality of fluid directors arranged in a housing adapted for insertion into a pipeline, the plurality of fluid directors having a number of fluid directors arranged circumferentially in the housing and one fluid director of the plurality of fluid directors centrally positioned within the housing;

flowing a fluid; thereby causing the fluid to be discharged from the pipeline cleaning apparatus into the pipeline;

a fluid director of the plurality of fluid directors repeatedly changing a direction of discharge of the fluid from the pipeline cleaning apparatus.

10. The method of claim 9, wherein flowing the fluid comprises elevating pressure in the pipeline on one side of the pipeline cleaning apparatus, the fluid being discharged from an opposite side of the apparatus.

11. The method of claim 9, wherein flowing the fluid comprises creating a pressure differential across the pipeline cleaning apparatus, thereby displacing the apparatus in the pipeline.

12. The method of claim 11, wherein the method includes controlling displacement of the pipeline cleaning apparatus through the pipeline by a restraining device applying a biasing force to the pipeline cleaning apparatus, thereby limiting the displacing.

13. The method of claim 9, wherein the inserting further comprises sealing the pipeline cleaning apparatus in the pipeline.

14. The method of claim 9, wherein the direction changing further comprises alternating the direction of discharge of the fluid.

15. The method of claim 9, wherein the direction changing further comprises oscillating the fluid back and forth.

16. The method of claim 9, wherein the direction changing further comprises sweeping the fluid back and forth across an interior surface of the pipeline.

17. A pipeline cleaning apparatus, comprising:

a housing adapted for insertion into a pipeline;

a plurality of fluid directors arranged in the housing the plurality of fluid directors having a number of fluid directors arranged circumferentially in the housing and one fluid director of the plurality of fluid directors centrally positioned within the housing such that at least one fluid director of the plurality of fluid directors is operable to repeatedly change a direction of discharge of fluid from the pipeline cleaning apparatus, in response to flow of the fluid through the pipeline cleaning apparatus, wherein the pipeline cleaning apparatus is arranged for displacement through the pipeline in response to a pressure differential being created across the pipeline cleaning apparatus in the pipeline.

18. The apparatus of claim 17, wherein the at least one fluid director causes the fluid to oscillate back and forth as the fluid is discharged from the at least one fluid director.

19. The apparatus of claim 17, wherein the at least one fluid director alternates the direction as the fluid is discharged from the at least one fluid director.

20. The apparatus of claim 17, wherein the at least one fluid director causes the fluid to sweep back and forth as the fluid is discharged from the at least one fluid director.

21. The apparatus of claim 17, wherein the at least one fluid director includes a fluidic switch which changes the direction of the fluid as the fluid is discharged from the at least one fluid director.

22. A pipeline cleaning apparatus, comprising:

a housing adapted for insertion into a pipeline;

at least one fluid director arranged in the housing, wherein the fluid director repeatedly changes a direction of discharge of fluid from the pipeline cleaning apparatus, in response to flow of the fluid through the apparatus; and a restraining, device coupled to the housing to operatively control displacement of the pipeline cleaning apparatus through a pipeline, in which the pipeline cleaning apparatus is operably placed, during a cleaning operation, the restraining device operable to apply a biasing force to the pipeline cleaning apparatus to counteract an oppositely directed force due to the pressure differential acting on the pipeline cleaning apparatus, wherein the at least one fluid director is one of a plurality of fluid directors, where the plurality of fluid directors includes a number of fluid directors arranged circumferentially in the housing and one fluid director of the plurality of fluid directors centrally positioned within the housing.

* * * * *